US009304494B2

(12) United States Patent
Courvoisier et al.

(10) Patent No.: US 9,304,494 B2
(45) Date of Patent: Apr. 5, 2016

(54) TIMEPIECE BALANCE SPRING STUD-HOLDER WITH SCREWS

(71) Applicant: ETA SA Manufacture Horlogere Suisse, Grenchen (CH)

(72) Inventors: Raphael Courvoisier, Corcelles (CH); Christian Ruefenacht, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/519,320

(22) Filed: Oct. 21, 2014

(65) Prior Publication Data

US 2015/0138930 A1 May 21, 2015

(30) Foreign Application Priority Data

Nov. 20, 2013 (EP) ..... 13193627

(51) Int. Cl.

| | |
|---|---|
| ***G04B 17/34*** | (2006.01) |
| ***G04B 15/14*** | (2006.01) |
| ***G04B 17/32*** | (2006.01) |

(52) U.S. Cl.

CPC ..... *G04B 17/34* (2013.01); *G04B 15/14* (2013.01); *G04B 17/32* (2013.01); *G04B 17/325* (2013.01)

(58) Field of Classification Search

CPC ..... G04B 15/14; G04B 17/34; G04B 17/04; G04B 17/06; G04B 17/32; G04B 17/063; G04B 18/02; G04B 18/006; G04B 17/325; E05B 2015/0235; E05B 2063/0026

See application file for complete search history.

(56) References Cited

U.S. PATENT DOCUMENTS

| | | | | |
|---|---|---|---|---|
| 3,046,725 | A * | 7/1962 | Vuilleumier | 368/178 |
| 3,120,097 | A * | 2/1964 | Dickerman | 368/174 |
| 3,154,912 | A * | 11/1964 | Pinkas | 368/176 |
| 3,579,977 | A * | 5/1971 | Meylan-Rochat | 368/173 |
| 3,630,017 | A * | 12/1971 | Marti | 368/176 |
| 3,673,376 | A * | 6/1972 | Kullmann | 219/121.64 |
| 7,059,764 | B2 * | 6/2006 | Hintze et al. | 368/127 |

(Continued)

FOREIGN PATENT DOCUMENTS

| | | |
|---|---|---|
| CH | 332 548 | 9/1958 |
| DE | 20 2010 014 253 U1 | 2/2011 |
| EP | 2 290 477 A1 | 3/2011 |

OTHER PUBLICATIONS

English Translation of Damasko, DE202010014253, translated May 20, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

An assembly to hold a balance spring includes a balance spring stud, and a stud-holder. The stud-holder includes a housing to receive the stud, a mechanism to secure the stud including a screw orthogonal to the stud, and a mechanism to secure the stud-holder to an escapement mechanism. The stud includes a surface to orient a balance spring. The screw partially passes through the stud to hold the stud in an indexed position. The stud includes an internal thread cooperating with the screw and forming the orientation surface. The stud-holder includes a bore for the passage of the screw, a bearing face arranged at the entry of said bore, on the opposite side to the housing, for the abutment of a head of the screw.

5 Claims, 1 Drawing Sheet

(56) References Cited

U.S. PATENT DOCUMENTS

2010/0188941 A1* 7/2010 Fujieda ..... 368/324
2011/0051565 A1 3/2011 Schmiedchen

OTHER PUBLICATIONS

European Search Report issued Jun. 11, 2014 in European Application 13193627, filed on Nov. 20, 2013 (with English Translation).

* cited by examiner

TIMEPIECE BALANCE SPRING STUD-HOLDER WITH SCREWS

This application claims priority from European Patent Application No. 13193627.0 filed 20.11.2013, the entire disclosure of which is incorporated herein by reference.

FIELD OF THE INVENTION

The invention concerns an assembly for holding or supporting a timepiece balance spring including a balance spring stud and a stud-holder, wherein said stud-holder includes:

a first housing for receiving said balance spring stud;

means of securing said balance spring stud including at least one screw whose axis is orthogonal to that of said balance spring stud;

and means of securing said stud-holder to an escapement mechanism, said balance spring stud including at least one orientation surface defining a direction of holding or supporting a said balance spring, wherein said at least one screw at least partially passes through said balance spring stud to hold the stud in an indexed locking position.

The invention also concerns a timepiece escapement mechanism including at least one such assembly.

The invention also concerns a timepiece movement including at least one such escape mechanism.

The invention also concerns a timepiece comprising at least one such movement.

The invention concerns the field of timepiece escapement mechanisms including a balance spring.

BACKGROUND OF THE INVENTION

In numerous mass-produced calibres, the balance spring stud, forming the external point of attachment of the balance spring, is clipped to a stud-holder, which is a flat, stamped part.

In high end productions, the balance spring stud is screwed into a stud-holder which is a machined component. The retaining screw then works between the foot and threads of the screw. The head is never locked, which causes frequent breakage, as a result of the torsion stresses experienced when the foot is locked onto the balance spring stud and when the operator continues to turn the screw.

DE Utility Model No 202010024253 in the name of DAMASKO describes a balance spring stud with radial adjustment relative to the balance cock. The axially threaded stud cooperates with a cylindrical screw, whose head moves in a milled oblong groove.

EP Patent Application No 2290477A1 in the name of GLASHÜTTE UHRENBETRIEB describes a stud-holder which includes an internal thread for securing the stud retaining screw, which cooperates with a recess in said stud, over one part of the thickness of the stud.

SUMMARY OF THE INVENTION

The invention proposes to create a modified balance spring stud, so as to correct the use of the screw, so that the screw can operate normally, by elastic deformation between its head and threads. Thus, the issue is to reduce the risk of breakage while maintaining the high-end structure of a stud holder with screws.

To this end, the invention concerns an assembly for holding or supporting a timepiece balance spring including a balance spring stud and a stud-holder, wherein the stud-holder includes:

a first housing for receiving said balance spring stud;

means of securing said balance spring stud including at least one screw whose axis is orthogonal to that of said balance spring stud;

and means of securing said stud-holder to an escapement mechanism, said balance spring stud including at least one orientation surface defining a direction of holding or supporting a said balance spring, wherein said at least one screw at least partially passes through said balance spring stud to hold the stud in an indexed locking position, characterized in that said stud includes at least one internal thread cooperating with said at least one screw, said internal thread forming said orientation surface, and said stud-holder includes:

a first bore for the passage of each said at least one screw;

a first bearing face for the abutment of a screw head comprised in said at least one screw, said bearing face being disposed at the entry of said first bore, on the opposite side to said first housing for said stud.

The invention also concerns a timepiece escapement mechanism including at least one such assembly.

The invention also concerns a timepiece movement including at least one such escape mechanism.

The invention also concerns a timepiece including at least one movement of this type, characterized in that the timepiece is a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 2:
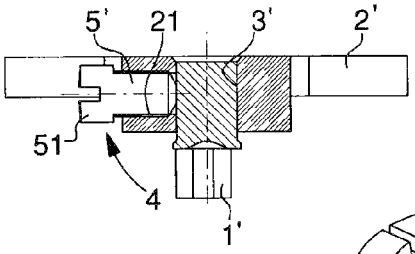
(Background Art) Fig. 2
FIG. 2 is a cross-section, in a plane through the axis of the screw and the axis of the balance spring stud, of the assembly of FIG. 1.

The invention concerns an assembly 20 for holding or supporting a timepiece balance spring 21 including a balance spring stud 1 and a stud-holder 2.

This stud-holder 2 includes:

a first housing 3 for receiving balance spring stud 1;

means 4 for securing balance spring stud 1 including at least one screw 5;

and means 6 of securing stud-holder 2 to an escapement mechanism 30, Balance spring stud 1 includes at least one orientation surface 7 defining a direction of holding or supporting a balance spring 21 of this type.

Figure 1:
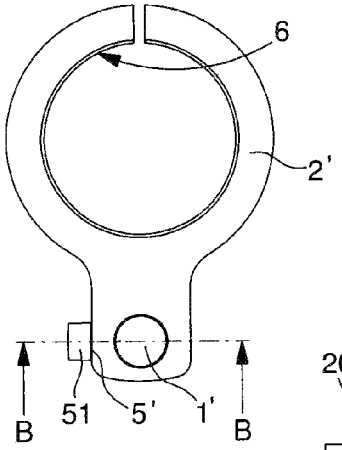
(Background Art) Fig. 1
FIG. 1 shows a schematic, plan view of an assembly for holding a balance spring according to the prior art, including a stud-holder, a balance spring stud housed in a bore of the stud-holder, and a screw engaged in an internal thread of the stud-holder and bearing on the balance spring stud.
Figure 3:
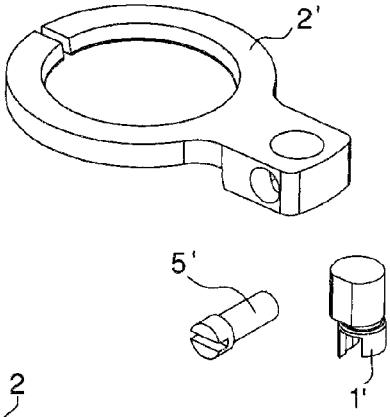
(Background Art) Fig. 3
FIG. 3 shows a schematic, perspective, exploded view of the assembly of FIG. 1.

FIG. 1 illustrates the prior art, with a balance spring stud 1' housed in a bore 3' of stud-holder 2' and a screw 5', whose axis is orthogonal to that of balance spring stud 1' and which is engaged in an internal thread 21 of stud-holder 2' and bears on a lateral face of balance spring stud 1'.

According to the invention, said at least one screw 5 at least partially passes through balance spring stud 1 to hold the stud in an indexed locking position.

Figure 5:
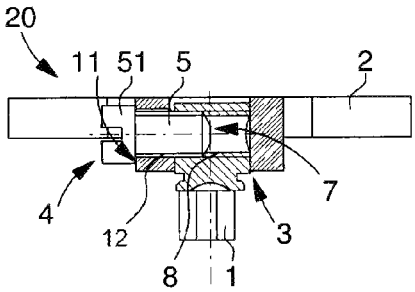
FIG. 5 shows, in a similar manner to FIG. 2, the assembly of FIG. 4.
Figure 4:
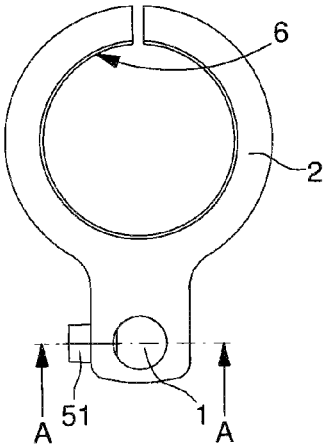
FIG. 4 shows, in a similar manner to FIG. 1, a first embodiment of the invention, wherein the screw passes through a bore of the stud-holder and cooperates with an internal thread of the balance spring stud.
Figure 6:
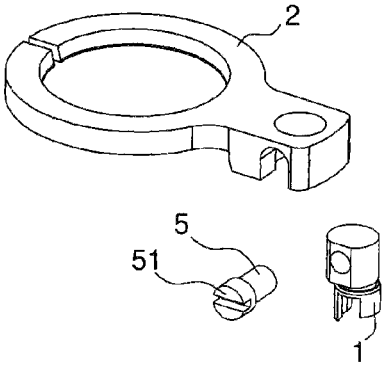
FIG. 6 shows, in a similar manner to FIG. 3, the assembly of FIG. 4.
Figure 7:
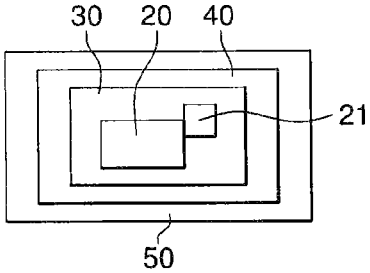
FIG. 7 is a block diagram showing a timepiece comprising a movement which includes an escapement mechanism including a balance spring held by an assembly according to the invention.

According to a first embodiment of the invention, as seen in FIGS. 4 to 6, balance spring stud 1 includes at least one internal thread 8 cooperating with said at least one screw 5. This internal thread 8 forms orientation surface 7.

This stud-holder 2 includes:

a first bore 12 for the passage of each at least one screw 5;

a first bearing face 11 for the abutment of a screw head 51 comprised in said at least one screw 5, said bearing face 11 being disposed at the entry of first bore 12, on the opposite side to first housing 3 for balance spring stud 1.

Screw head 51 abuts on first bearing face 11 of stud-holder 2. In this first embodiment, screw 5 is used in a conventional manner, operating by elastic deformation of its threads. Balance spring stud 1 is no longer pushed against stud-holder 2 as in the prior art, but is pulled towards stud-holder 2 by screw 5. The orientation is given by screw head 51 which determines the orientation of screw 5 and thus of the internal thread 8 of the balance spring stud, which forms orientation surface 7 of balance spring stud 1 for holding balance spring 21.

Stud-holder 2 may include a recess to allow for adjustment of the flatness of the balance spring by unscrewing the screw. Indeed, watchmakers take care always to position the balance spring so that it is as flat as possible. If the point of attachment on the balance spring stud is, for example, lower than the point of attachment on the balance staff, the balance spring will tend to adopt an umbrella shape. To correct this phenomenon, the watchmaker unscrews the balance spring stud screw and raises the balance spring stud until the two points of attachment are at the same height, and the balance spring is thus made flat again. However, this adjustment is only possible where the balance spring stud can be moved inside the stud-holder. In the first embodiment of FIG. 5, the balance spring stud can only be moved downwards; in this case, the nominal position of the stud would have to be chosen so that the screw is centered in the aperture to allow for correction in both directions. In a second embodiment, the hole passing through the stud prevents movement. An adjustment is not possible in a version with a cylindrical hole; in a variant an oblong allows for this adjustment in height.

Preferably, in this first embodiment, there is only one screw 5, and only one internal thread 8 of balance spring stud 1.

The invention also concerns a timepiece escapement mechanism 30 including at least one such assembly 20.

The invention also concerns a timepiece movement 40 including at least one escapement mechanism 30 of this type.

The invention also concerns a timepiece 50 including at least one such movement 40. Specifically, this timepiece 50 is a watch.

The invention provides various advantages:

the screw does not work in torsion, but in traction, and the risk of breaking the screw is reduced;

a stable adjustment is ensured and allows for integration into a high-end movement.

the stud-holder assembly according to the invention is interchangeable with a prior art stud-holder, which makes it possible to improve existing movements.

What is claimed is:

1. An assembly to hold or support a timepiece balance spring, the assembly including a balance spring stud and a stud-holder, the stud-holder comprising:

a first housing to receive said balance spring stud;

at least one screw to secure said balance spring stud, a longitudinal axis of the at least one screw being orthogonal to a longitudinal axis of said stud; and a securing mechanism to secure said stud-holder to an escapement mechanism, said balance spring stud including at least one orientation surface defining a direction of holding or supporting said balance spring, wherein said at least one screw at least partially passes through said balance spring stud to hold the stud in an indexed locking position, wherein said stud includes at least one internal thread cooperating with said at least one screw, said internal thread forming said orientation surface, and said stud-holder includes:

a first bore for the passage of each said at least one screw; and a first bearing face abutted by a screw head comprised in said at least one screw, said bearing face being disposed at an entry of said first bore, on an opposite side to said first housing for said stud.

2. A timepiece escapement mechanism including at least one assembly according to claim 1.

3. A timepiece movement including at least one escapement mechanism according to claim 2.

4. A timepiece including at least one movement according to claim 3, wherein the timepiece is a watch.

5. The assembly according to claim 1, wherein said stud is pulled toward said stud-holder by said at least one screw.

* * * * *